US009082355B2

(12) United States Patent
Kim et al.

(10) Patent No.: US 9,082,355 B2
(45) Date of Patent: Jul. 14, 2015

(54) CIRCUIT FOR DRIVING LCD DEVICE AND DRIVING METHOD THEREOF

(75) Inventors: Soo Woo Kim, Daejeon-si (KR); An Young Kim, Daejeon-si (KR); Joon Ho Na, Daejeon-si (KR); Dae Seong Kim, Daejeon-si (KR); Dae Keun Han, Daejeon-si (KR)

(73) Assignee: SILICON WORKS CO., LTD., Daejeon-Si (KR)

( * ) Notice: Subject to any disclaimer, the term of this patent is extended or adjusted under 35 U.S.C. 154(b) by 500 days.

(21) Appl. No.: 13/000,882

(22) PCT Filed: May 22, 2009

(86) PCT No.: PCT/KR2009/002694

§ 371 (c)(1),
(2), (4) Date: Dec. 22, 2010

(87) PCT Pub. No.: WO2010/002106

PCT Pub. Date: Jan. 7, 2010

(65) Prior Publication Data

US 2011/0109816 A1 May 12, 2011

(30) Foreign Application Priority Data

Jun. 30, 2008 (KR) ..... 10-2008-0062264

(51) Int. Cl.
*G09G 3/36* (2006.01)
*G09G 5/00* (2006.01)

(52) U.S. Cl.
CPC ..... *G09G 3/3614* (2013.01); *G09G 3/3688* (2013.01); *G09G 2310/027* (2013.01); *G09G 2310/08* (2013.01); *G09G 2370/08* (2013.01)

(58) Field of Classification Search
USPC ..... 345/204, 100; 348/792
See application file for complete search history.

(56) References Cited

U.S. PATENT DOCUMENTS

| | | | | |
|---|---|---|---|---|
| 4,766,430 | A * | 8/1988 | Gillette et al. | 345/89 |
| 5,764,212 | A * | 6/1998 | Nishitani et al. | 345/98 |
| 5,796,379 | A * | 8/1998 | Enomoto et al. | 345/89 |
| 6,008,801 | A * | 12/1999 | Jeong | 345/204 |
| 6,097,362 | A * | 8/2000 | Kim | 345/87 |
| 6,661,402 | B1 * | 12/2003 | Nitta et al. | 345/99 |

(Continued)

FOREIGN PATENT DOCUMENTS

| | | |
|---|---|---|
| CN | 1417771 | 5/2003 |
| CN | 1432989 | 7/2003 |

(Continued)

OTHER PUBLICATIONS

International Search Report, Application No. PCT/KR2009/002694, dated Jan. 20, 2010.
Written Opinion of the International Searching Authority, Application No. PCT/KR2009/002694, dated Jan. 20, 2010.

*Primary Examiner* — Temesgh Ghebretinsae
*Assistant Examiner* — Benyam Ketema
(74) *Attorney, Agent, or Firm* — Kile Park Reed & Houtteman PLLC

(57) ABSTRACT

A liquid crystal display driving circuit and method. A data register block of a controller applies in advance a polarity control signal to data before the data are stored in latches of a data driver, exchanges the data, and then stores the exchanged data in the latches. Thereby, it is possible to provide multiplexers, which are otherwise required for respective channels, to one controller and to decrease the size of a chip.

2 Claims, 4 Drawing Sheets

(56) References Cited

U.S. PATENT DOCUMENTS

| | | | | |
|---|---|---|---|---|
| 7,180,497 | B2 * | 2/2007 | Lee et al. | 345/98 |
| 7,259,739 | B2 * | 8/2007 | Yun et al. | 345/93 |
| 7,379,046 | B2 * | 5/2008 | Toriumi et al. | 345/100 |
| 2002/0154151 | A1 * | 10/2002 | Koyama | 345/690 |
| 2003/0117362 | A1 * | 6/2003 | An | 345/98 |
| 2003/0151584 | A1 | 8/2003 | Song et al. | |
| 2003/0197672 | A1 | 10/2003 | Yun et al. | |
| 2004/0080522 | A1 * | 4/2004 | Nitta et al. | 345/690 |
| 2004/0104872 | A1 | 6/2004 | Kang et al. | |

FOREIGN PATENT DOCUMENTS

| | | | |
|---|---|---|---|
| JP | 7-191631 | | 7/1995 |
| JP | 11-102174 | A | 4/1999 |
| JP | 11-231822 | | 8/1999 |
| JP | 11-305735 | | 11/1999 |
| KR | 10-1999-0001493 | A | 1/1999 |
| KR | 10-2003-0051150 | A | 6/2003 |
| KR | 2003-0054902 | | 7/2003 |
| KR | 10-2005-0000646 | A | 1/2005 |
| TW | I261796 | | 9/2006 |
| TW | I288906 | | 10/2007 |

* cited by examiner

Conventional LCD Driving Circuit

CIRCUIT FOR DRIVING LCD DEVICE AND DRIVING METHOD THEREOF

BACKGROUND OF THE INVENTION

1. Field of the Invention

The present invention relates to a liquid crystal display driving circuit and method, and more particularly, to a liquid crystal display driving circuit and method, in which a data register block of a controller applies in advance a polarity control signal to data before the data are stored in first latches of a data driver, exchanges the data, and then stores the exchanged data in the first latches, thereby making it possible to provide multiplexers required for respective channels in one controller so that the size of a chip can be decreased.

2. Description of the Related Art

In general, a liquid crystal display (LCD) is one of flat panel displays that adjust light transmittance of liquid crystal cells using optical characteristics of liquid crystal whose molecular arrangement is varied by an electric field, thereby displaying characters, symbols or graphics.

Referring to FIG. 1, a conventional LCD driving circuit 10 supplies scan pulses and data to intersections between data lines and gate lines of a liquid crystal panel having thin film transistors (TFTs) as switching elements for driving liquid crystal cells, and outputs video data. The LCD driving circuit 10 includes a controller 20 which receives video data from a video card, etc., divides the received data into even-numbered data and odd-numbered data and transmits the divided data to latches of respective channels, and a data driver 30 which receives the divided data, latches the received data in response to an enable signal, exchanges data with adjacent channels according to a polarity control signal POL and outputs the exchanged data to data lines.

The controller 20 includes an Rx buffer which receives from the video card, etc. and temporarily stores a low-voltage input signal 'mini-LVDS (low voltage differential signaling) input data' as video data to be displayed, and a data register which divides the video data into the even-numbered and odd-numbered data and supplies the divide data to first latches of the data driver 30.

Further, the data driver 30 provided to each pair of channels includes first latches which sequentially sample the video data inputted from the data register in response to a first enable signal '$1^{st}$ Latch enable' generated by a shift register, second latches which latch the data inputted from the first latches and output the latched data in response to a second enable signal '$2^{nd}$ Latch enable,' and multiplexers (MUXes) which select one of a positive polarity gamma voltage and a negative polarity gamma voltage corresponding to respective gray scale values of the video data in response to the polarity control signal POL, exchange the data outputted from the second latches with adjacent channels and then supply the exchanged data to the respective data lines.

In this manner, in supplying the video data to be displayed to the data lines of the liquid crystal panel, the multiplexers for exchanging data with adjacent channels in response to the polarity control signal POL are required. Since the conventional LCD driving circuit receives a current horizontal synchronizing signal of the video data outputted and determines the output polarity of an amplifier provided to a gamma reference voltage generator, the multiplexers should be configured to be connected to the output terminals of the second latches provided to the respective channels through which the video data are output to the data lines.

Accordingly, in the conventional LCD driving circuit, because the multiplexers should be provided to the respective channels, problems are caused in that the size of a region, in which each channel is formed, cannot but be increased, and thus, the size of a semiconductor chip cannot but be increased.

SUMMARY OF THE INVENTION

Accordingly, the present invention has been made keeping in mind the above problems occurring in the related art, and an object of the present invention is to provide a liquid crystal display driving circuit and method, wherein data are exchanged in advance according to a polarity control signal before being stored in latches of respective channels by a system which has multiplexers integrated to a controller, recognizes the polarity control signal from a current load signal, exchanges data in response to the polarity control signal and outputs the exchanged data to data lines in response to a next load signal, thereby making it possible to removing the multiplexers required for the respective channels so that the size of a channel region and the overall size of a semiconductor chip can be decreased.

According to one aspect of the present invention, there is provided a liquid crystal display driving circuit, which supplies data and scan pulses to intersections between data and gate lines of a liquid crystal panel and displays the liquid crystal panel, comprising a controller configured to receive video data and divide the received data into even-numbered data and odd-numbered data, and having integrated multiplexers which exchange in advance the divided data between adjacent channels in response to a polarity control signal and transmit the exchanged data to latches of respective channels; and a data driver provided to each channel through which the video data is output to the data line, receiving the data from the controller, latching the data in response to an enable signal, and outputting the data to the data line.

Here, the controller may include a buffer receiving and temporarily storing the video data; a data register dividing the received video data into the even-numbered data and the odd-numbered data; and multiplexers selecting polarity of output according to the polarity control signal, previously exchanging the divided data between the adjacent channels, and transmitting the exchanged data to the latches of the data driver. The data driver includes first latches sequentially sampling the video data exchanged by the multiplexers; and second lathes latching the data input from the first latches and outputting the latched data to each data line.

Further, the controller may be configured so that the multiplexers make separation between a load signal recognizing the polarity control signal to exchange the data and a load signal supplying even-numbered data output and odd-numbered data output to the data line, and exchange the data according to the polarity control signal before the data are stored in the first latches of the respective channels.

In addition, the controller may be configured to recognize the polarity control signal using a current load signal, and cause the multiplexers to exchange the data according to the polarity control signal and to store the exchanged data in the first latches, and to synchronize the polarity control signal to a next load signal after one horizontal synchronizing signal, and determine the polarity of the output.

According to another aspect of the present invention, there is provided a liquid crystal display driving method, comprising the steps of receiving and temporarily storing, by a buffer of a controller, video data; dividing, by a data register, the received video data into even-numbered data and odd-numbered data; recognizing a polarity control signal through a current load signal, and previously exchanging, by multiplexers integratedly provided to the controller, the divided data between adjacent channels; storing the even- and odd-numbered data exchanged by the multiplexers in first and second latches provided to each channel; and supplying even-numbered data output and odd-numbered data output to a data line according to polarity determined by the current polarity control signal in synchronization with a next load signal.

BRIEF DESCRIPTION OF THE DRAWINGS

The above and other objects, features and advantages of the present invention will be more clearly understood from the following detailed description when taken in conjunction with the accompanying drawings, in which.

DETAILED DESCRIPTION OF PREFERRED EMBODIMENTS

Figure 1:
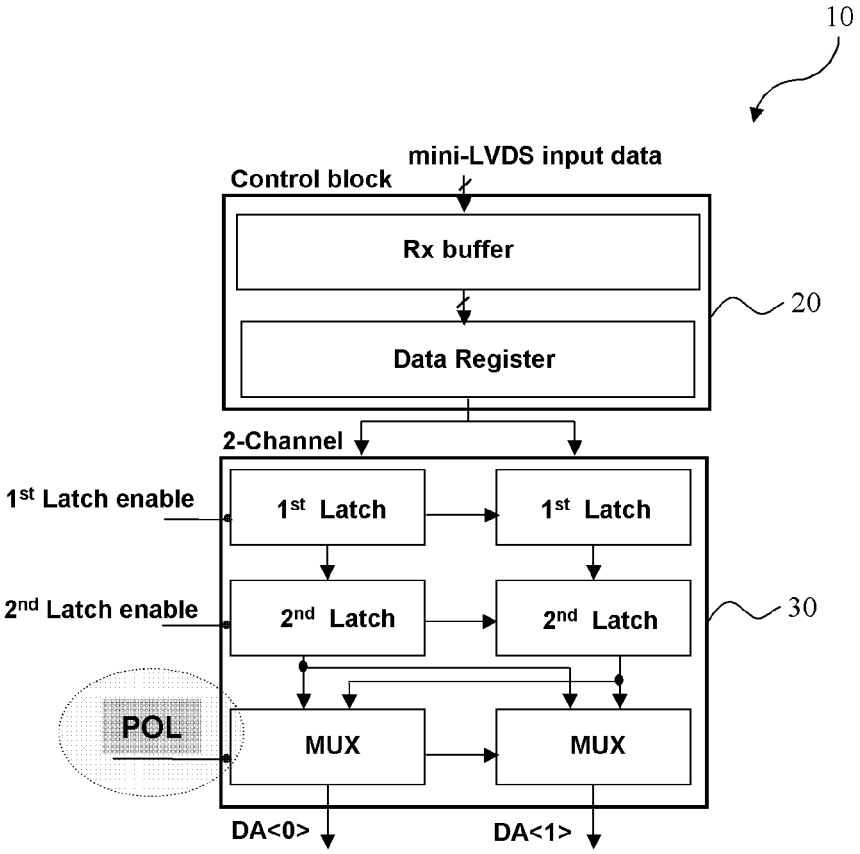
FIG. 1 is a block diagram illustrating the configuration of a conventional LCD driving circuit.

Reference will now be made in greater detail to exemplary embodiments of the invention with reference to the accompanying drawings. Wherever possible, the same reference numerals will be used throughout the drawings and the description to refer to the same or like parts.

Figure 2:
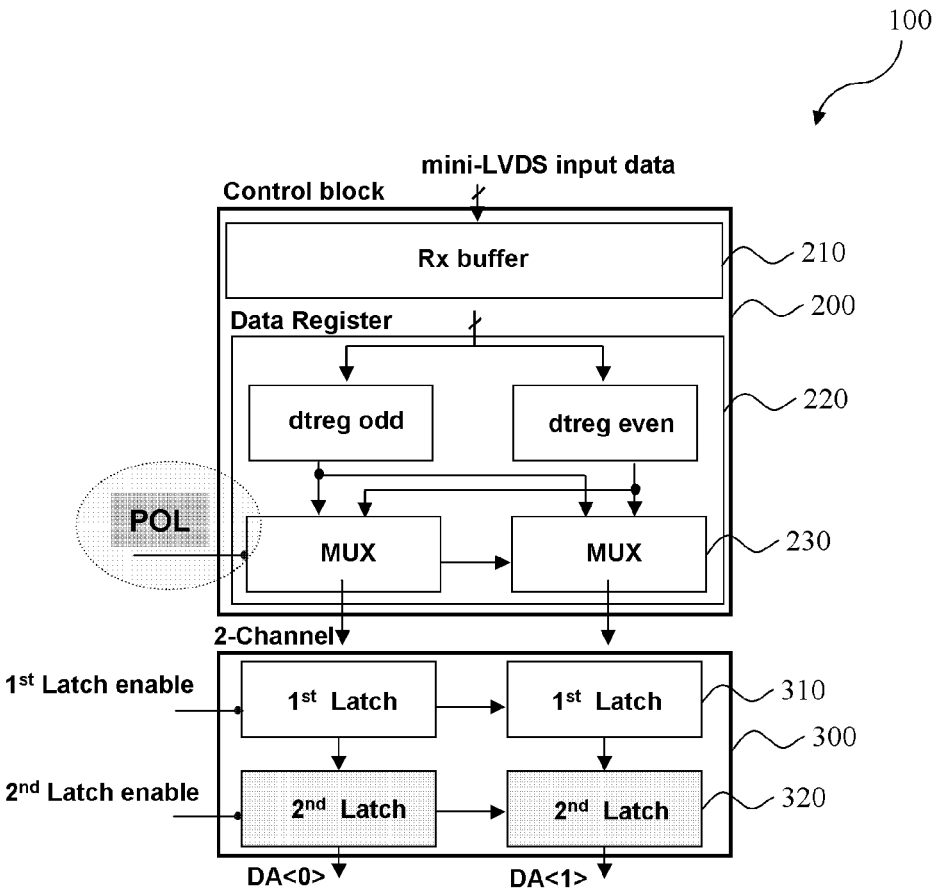
FIG. 2 is a block diagram illustrating the configuration of an LCD driving circuit in accordance with an embodiment of the present invention.

As shown in FIG. 2, a liquid crystal display (LCD) driving circuit 100 in accordance with an embodiment of the present invention includes a controller 200 which receives video data to divide them into even-numbered data and odd-numbered data, exchange the divided data with adjacent channels in response to a polarity control signal POL and transmits the exchanged data to latches of the respective channels, and a data driver 300 which receives the data from the controller 200, latches the data in response to an enable signal and outputs the data to data lines.

The controller 200 includes an Rx buffer 210 which receives and temporarily stores a low-voltage input signal 'mini-LVDS (low voltage differential signaling) input data' as video data, a data register 220 which divides the received video data into even-numbered data 'dtreg even' and odd-numbered data 'dtreg odd', and multiplexers (MUXes) 230 which select one of positive and negative polarity gamma voltages corresponding to respective gray scale values of the video data, exchange the data divided by the data register 220 with adjacent channels in response to the polarity control signal POL and transmit the exchanged data to the latches of the respective channels. At this time, the multiplexers 230 may be configured not only to be separately installed in the controller 200 but also to be installed together in the data register 220 such that the even-numbered and odd-numbered data divided from the video data are directly exchanged in response to the polarity control signal POL.

Further, the controller 200 generates a data driving control signal and a gate driving control signal using horizontal and vertical synchronizing signals H and V inputted along with the video data in order to control the LCD driving circuit 100. The data driving control signal is configured to be transmitted to the data driver 300 along with a first latch enable signal '$1^{st}$ Latch enable,' a second latch enable signal '$2^{nd}$ Latch enable', and so on. The polarity control signal POL is configured to be transmitted to the multiplexers 230 installed in the controller 200.

The polarity control signal POL is a signal used for selecting polarity of a channel output, and is configured to be applied to an output of an amplifier of a current gamma reference voltage generator before one horizontal synchronizing signal (1H time). Thus, the polarity control signal POL is applied in advance before the video data are stored in first latches 310 provided to the respective channels, and the video data are exchanged and stored in the first latches 310. At this time, the polarity control signal POL is synchronized to a load signal after one horizontal synchronizing signal (1H time), and determines the polarity of the channel output.

In this manner, since the polarity control signal POL is received and reflected to a next output, immediately after the video data are divided by the data register of the controller before stored in the first latches 310, the divided video data are directly exchanged by the multiplexers 230. Thereby, the multiplexer required for each channel can be removed.

The data driver 300 is provided to each pair of channels transmitting the video data to the data lines, and includes first latches 310 which sequentially sample the video data exchanged by the multiplexers 230 in response to the first latch enable signal '$1^{st}$ Latch enable,' and second latches 320 which latch the sampled data input from the first latches and output the latched data to the respective data lines in response to the second latch enable signal '$2^{nd}$ Latch enable.'

In this manner, the controller 200 applies the polarity control signal POL before one horizontal synchronizing signal to the output of the amplifier AMP of the current gamma reference voltage generator, and exchanges in advance the data with adjacent channels in response to the polarity control signal POL. Thereby, it is possible to remove the multiplexer required for each channel, and thus to reduce the size of a channel region where each channel is formed. As a result, it is possible to significantly decrease the overall size of a semiconductor chip for the LCD driving circuit.

Figure 3:
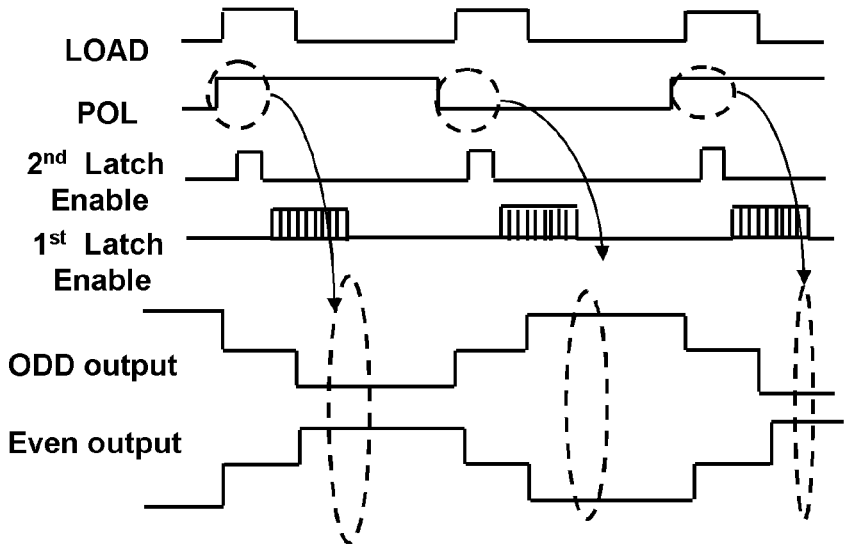
FIG. 3 is a timing diagram of the conventional LCD driving circuit in which multiplexers are provided to respective channels.
Figure 4:
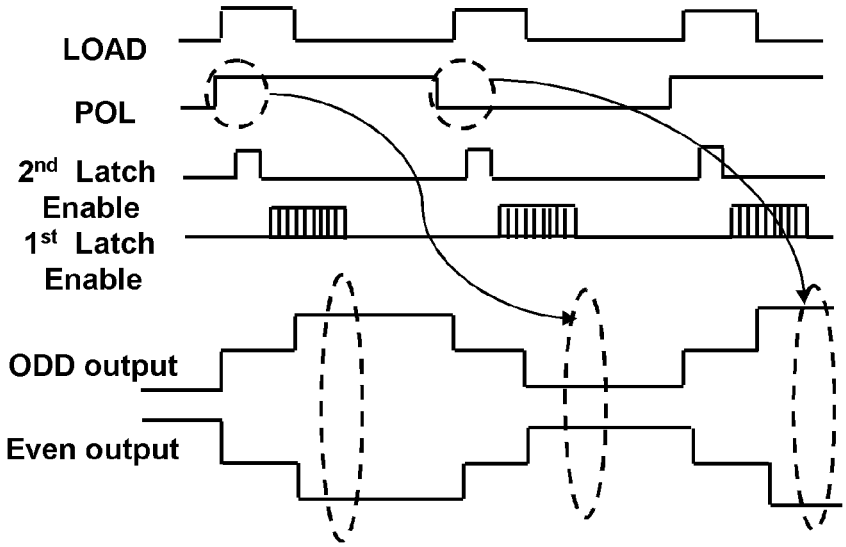
FIG. 4 is a timing diagram of the LCD driving circuit in accordance with the embodiment of the present invention, in which multiplexers are integrated to a controller.

FIG. 3 is a timing diagram of a conventional LCD driving circuit in which multiplexers are provided to respective channels, and FIG. 4 is a timing diagram of an LCD driving circuit in accordance with the embodiment of the present invention in which multiplexers are integrated to a controller.

Referring to FIG. 3, in the case where multiplexers are provided to respective channels, the data driver recognizes a polarity control signal POL through a current load signal LOAD that determines whether or not to output data, and supplies an even-numbered data output 'EVEN output' and an odd-numbered data output 'ODD output' to data lines according to polarity determined by the polarity control signal POL on the basis of a common voltage, which is supplied between the drain terminal of a TFT and a storage capacitor, in synchronism with the current load signal LOAD.

In this manner, in the case where the multiplexers are provided to the respective channels, even-numbered and odd-numbered data, which are divided from video data by the data register 220 of the controller, are transmitted to the respective channels, and the multiplexers provided to the respective channels recognize the polarity control signal POL through the current load signal LOAD, select the polarities of the outputs, and exchange the transmitted data with the adjacent channels.

As shown in FIG. 4, in the case in which multiplexers are integrated to a controller and thus are removed from respective channels, the data driver recognizes a polarity control signal POL through a current load signal LOAD that determines whether or not to output data, and the multiplexers 230 provided to the data register 220 of the controller exchange data in response to the polarity control signal POL, and then store the exchanged data in the first latches 310 of the respective channels.

In this manner, the even-numbered data and the odd-numbered data, which are exchanged by the current polarity control signal POL and then are stored, have polarity of output determined in synchronism with a next load signal LOAD. Thus, even-numbered data output 'EVEN output' and odd-numbered data output 'ODD output' are supplied to a data line according to the polarity determined by the current polarity control signal POL on the basis of a common voltage in synchronism with the next load signal. Here, it is natural that temporal points of transition, i.e. rising edge and falling edge, of the load signals, may be selectively used depending on the design and the use of the LCD driving circuit.

Accordingly, since video data can be outputted as in the case where the multiplexers are provided to the respective channels, the same output results can be obtained while the size of a semiconductor chip, particularly, the size of a channel region is significantly decreased.

Figure 5:
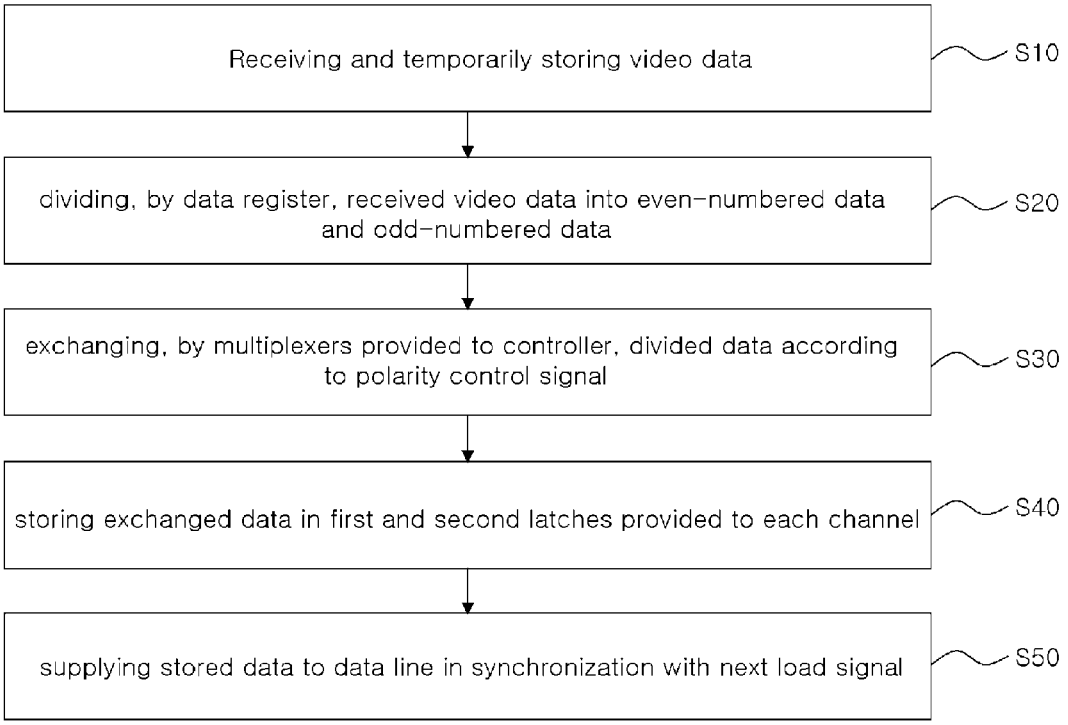
FIG. 5 is a flowchart showing an LCD driving method in accordance with another embodiment of the present invention.

Now, an LCD driving method in accordance with another embodiment of the present invention will be described with reference to FIG. 5.

In the present embodiment, the method for driving an LCD, in which multiplexers are removed from respective channels and instead are integrated to a controller, includes the steps of receiving and temporarily storing a low-voltage input signal 'mini-LVDS input data' as video data by a buffer (S10), dividing the received video data into even-numbered data and odd-numbered data by a data register (S20), recognizing a polarity control signal POL through a current load signal LOAD and exchanging the divided data with adjacent channels by multiplexers provided to the controller (S30), storing the even-numbered and odd-numbered data exchanged by the multiplexers in the first and second latches provided to each channel (S40), and supplying an even-numbered data output 'EVEN output' and an odd-numbered data output 'ODD output' to data lines according to polarity determined by the current polarity control signal POL on the basis of a common voltage VCOM in synchronism with a next load signal (S50).

In this manner, the load signal, which recognizes the polarity control signal POL and exchanges the data, is separated from the load signal, which supplies the even-numbered data output and the odd-numbered data output to the data lines, so that the data exchange based on the polarity control signal POL can be performed in advance before the divided data are stored in the latches. As a result, the multiplexers 230 are removed from the respective channels, and are integratedly to the controller 200, so that it is possible to decrease the size of the channel region and thus the overall size of the semiconductor chip.

As is apparent from the above description, multiplexers are integrated to only one controller provided to one semiconductor chip, so that the multiplexers required for respective channels can be removed to significantly decrease the overall size of a semiconductor chip.

Although exemplary embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A liquid crystal display driving circuit, which supplies data and scan pulses to intersections between data and gate lines of a liquid crystal panel and displays the liquid crystal panel, comprising:

a timing controller configured to receive video data and divide the received data into even-numbered data and odd-numbered data, and comprising a plurality of integrated multiplexers which directly exchange in advance of transmission to each channel the divided data between adjacent channels in response to a current polarity control signal and transmit the exchanged data to first latches of respective channels; and a data driver provided to each channel through which the video data are outputted to a data line, and configured to receive the exchanged data from the integrated multiplexers of the timing controller, latch the exchanged data using the first latches in response to a first latch enable signal, and output the data to the data line, wherein the timing controller comprises:

a buffer configured to receive and temporarily store the video data;

a data register configured to divide the received video data into the even-numbered data and the odd-numbered data; and the plurality of integrated multiplexers configured to recognize the current polarity control signal through a current load signal, exchange in advance the divided data between the adjacent channels in response to the current polarity control signal, and transmit the exchanged data to the first latches of the data driver; and wherein the data driver comprises:

the first latches configured to sequentially sample the video data exchanged by the integrated multiplexers in response to the first latch enable signal; and second latches configured to latch the data inputted from the first latches and output the latched data to data lines in response to a second latch enable signal, wherein the second latches output the latched data to the data lines by supplying an even-numbered data output and an odd-numbered data output to the data lines according to polarity determined by the current polarity control signal in synchronism with a next load signal, wherein there is one horizontal synchronizing signal (1H time) difference between the current load signal and the next load signal.

2. A liquid crystal display driving method performed by a liquid crystal display driving circuit, wherein the liquid crystal display driving circuit comprises a timing controller and a data driver, wherein the timing controller comprises a buffer, a data register, and a plurality of integrated multiplexers less than a number of data lines, and wherein the data driver comprises first latches and second latches, the method comprising:

receiving and temporarily storing, by the buffer of the timing controller, video data;

dividing, by the data register of the timing controller, the received video data into even-numbered data and odd-numbered data;

recognizing, by the integrated multiplexers of the timing controller, a current polarity control signal through a current load signal, directly exchanging in advance of transmission to each channel the divided data between adjacent channels in response to the current polarity control signal, and transmitting the exchanged data to the first latches of the data driver;

sequentially sampling, by the first latches of the data driver, the exchanged data in response to a first latch enable signal; and latching, by the second latches of the data driver, the data inputted from the first latches, and outputting the latched data to data lines in response to a second latch enable signal, wherein the outputting comprises supplying an even-numbered data output and an odd-numbered data output to the data lines according to polarity determined by the current polarity control signal in synchronism with a next load signal, wherein there is one horizontal synchronizing signal (1H time) difference between the current load signal and the next load signal.

* * * * *